United States Patent [19]

Bartels et al.

[11] 4,388,983

[45] Jun. 21, 1983

[54] LIGHTWEIGHT LADDER

[75] Inventors: Leroy R. Bartels, Hager City, Wis.; Arnold M. Milbright, Red Wing, Minn.

[73] Assignee: International Telephone and Telegraph Corporation, New York, N.Y.

[21] Appl. No.: 342,149

[22] Filed: Jan. 25, 1982

[51] Int. Cl.[3] ..... E06C 1/36; E06C 1/06

[52] U.S. Cl. ..... 182/189; 182/93; 182/100; 182/92; 182/206

[58] Field of Search ..... 182/92, 93, 100, 189, 182/206, 194, 134; 248/224.3, 221.3, 225.4, 314

[56] References Cited

U.S. PATENT DOCUMENTS

| | | | |
|---|---|---|---|
| 1,709,144 | 4/1929 | Mueller | 248/221.3 |
| 2,194,870 | 3/1940 | Pirsch | 182/189 |
| 2,924,291 | 2/1960 | Tunstead | 182/206 |
| 3,094,811 | 6/1963 | Feezel | 248/224.3 |
| 3,149,696 | 9/1964 | Anderson | 182/92 |
| 3,388,884 | 6/1968 | Eggler | 248/221.3 |
| 3,869,742 | 3/1975 | Gale | 182/189 |
| 3,930,562 | 1/1976 | Zorn | 182/92 |
| 3,995,714 | 12/1976 | Brookes | 182/189 |
| 4,069,892 | 1/1978 | Lynne | 182/93 |

*Primary Examiner*—Reinaldo P. Machado
*Attorney, Agent, or Firm*—James B. Raden; Donald J. Lenkszus

[57] ABSTRACT

A lightweight ladder includes a vertical member of flat sided tubing, rungs formed of angle metal, and ladder feet adapted to engage retaining clips mounted on a vertical structure. The ladder feed are designed to provide wedging between the clips and the vertical structure such that set screws are not required to keep the ladder in place and stable.

10 Claims, 7 Drawing Figures

LIGHTWEIGHT LADDER

BACKGROUND OF THE INVENTION

This invention pertains to ladders.

Transmission poles are often provided with ladders to permit inspection and maintenance. Typically the ladder is in sections. Each section includes at least an upper and lower ladder foot that fit in retaining clips which are fastened to the transmission pole. The ladder feet generally fit in the retaining clips with considerable clearance. At a point on the ladder foot below the normal level of the retaining clip, a set screw is inserted into a drilled and tapped hole in the ladder foot. By tightening the set screws, the clearances are reduced, thus making the ladder stable. Significant amounts of time are needed to install and remove ladders with set screws.

SUMMARY OF THE INVENTION

In accordance with the principles of the invention, a ladder is provided having an improved ladder foot. The ladder foot is coupled to the ladder by means of a horizontally extending leg. The ladder foot includes a first portion extending from the leg at an angle to vertical. A second portion extends downward from the first portion and parallel to the ladder. The second portion of the foot is inserted into a clip attached to the structure on which the ladder is to be mounted. The vertically offset first section provides a self seating action in the clip and additionally provides a wedging action of the foot in the clip such that the foot will seat itself in the clip and provide transverse stability. When a load is not provided on the ladder, it is easily removable by lifting the ladder.

Further in accordance with the invention, an improved light weight ladder is provided. The ladder comprises a single vertical support formed of flat sided tubing and having a plurality of rungs welded thereon, each rung being formed of angle iron. Each rung has its ends bent upward preferably at a 45° angle. Two horizontal legs project from the vertical support and each carries a ladder foot as described above.

BRIEF DESCRIPTION OF THE DRAWING

The invention will be better understood from a reading of the following detailed description in conjunction with the drawings in which.

DETAILED DESCRIPTION

Figure 1:
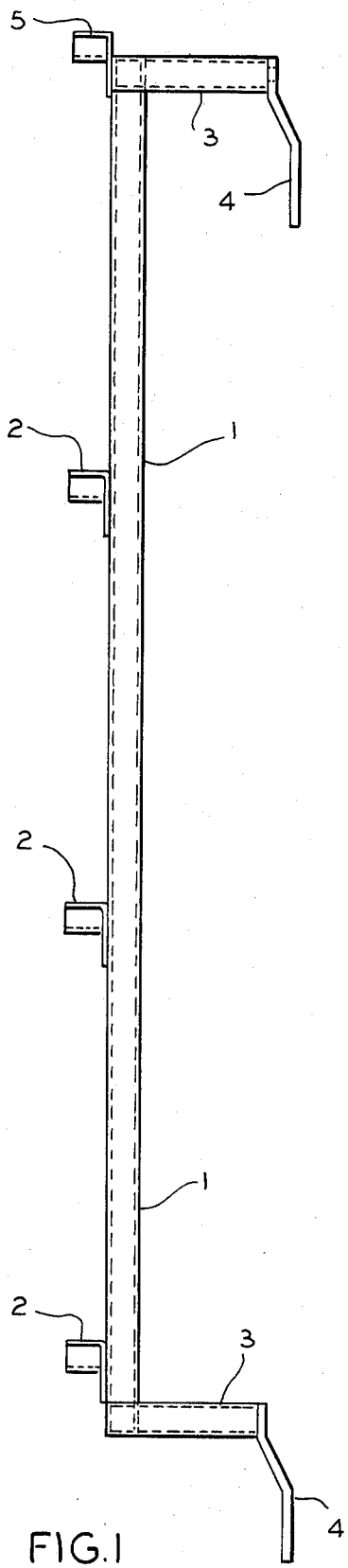
FIG. 1 is a side view of a ladder in accordance with the invention.
Figure 2:
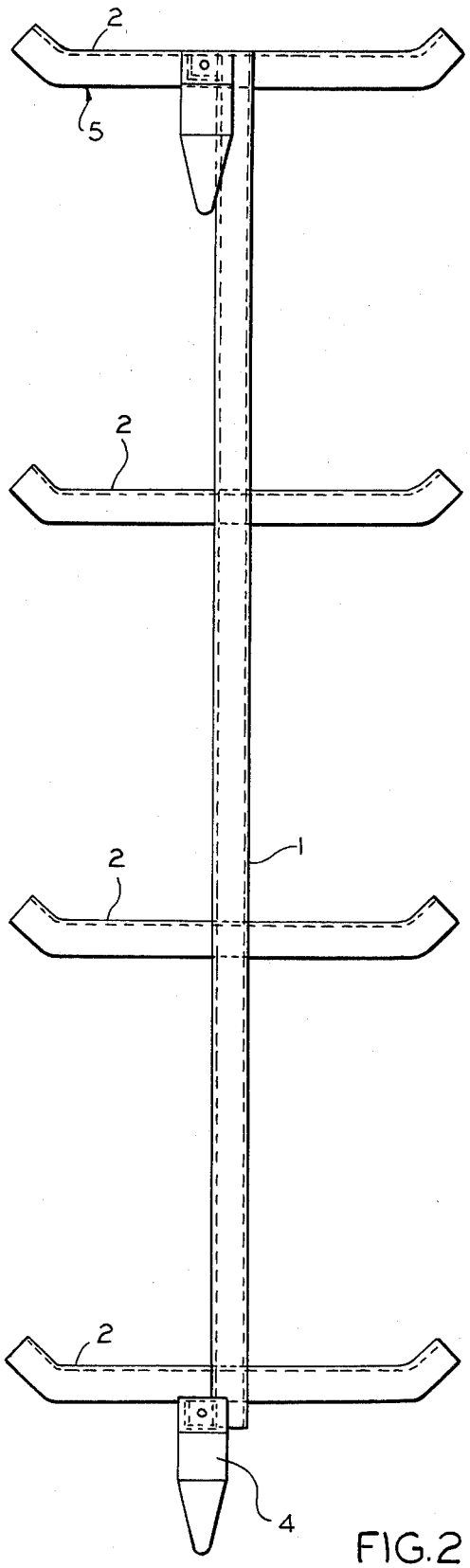
FIG. 2 is a rear view of the ladder of FIG. 1.
Figure 3:
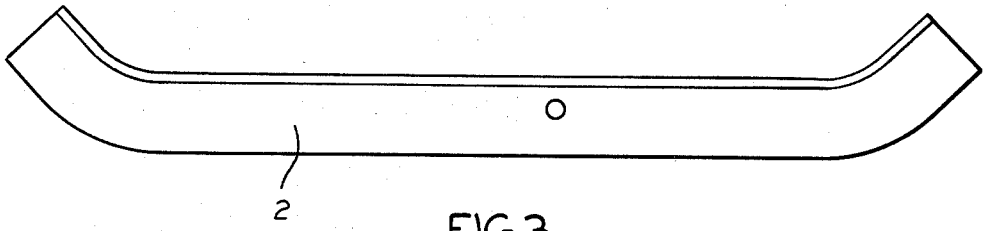
FIG. 3 is a front view of one rung of the ladder of FIG. 1.

Typically, transmission poles have ladder clips positioned approximately 4 feet apart and ladders for such poles are erected in sections. Turning to FIGS. 1 and 2 a ladder section in accordance with the invention comprises a vertical support 1 formed from $1'' \times 1'' \times \frac{1}{8}$ square tubing, 47 7/16" long. Each ladder rung 2 is formed from $1\frac{1}{4}'' \times 1\frac{1}{4} \times \frac{1}{8}''$ angle 15" long. Each rung end is bent upwards at 45° on a $1\frac{1}{4}''$ radius along an axis $1\frac{1}{2}''$ in from the end. The rungs may be fastened to the support 1 by any conventional means. In the illustrative embodiment, the rungs are welded in place at spaced apart distances of 15 inches. Two legs 3 are attached to the support 1. Each leg is formed of $1'' \times 1'' \times \frac{1}{8}''$ square tubing $5\frac{1}{4}''$ long. The legs may be fastened to the support 1 by any conventional manner but in the illustration embodiment are welded thereto.

At the end of each leg is a foot 4 formed from flat bar $1\frac{1}{2}'' \times \frac{1}{4}'' \times 5\frac{1}{2}''$ long which is formed with an intermediate section offset 25° from vertical. With the offset, the top and bottom portions of the foot are offset by $1\frac{1}{8}''$ and the foot so formed has a length of $5\frac{3}{8}''$.

The feet 4 may be attached to the legs 3 by any conventional means. In the embodiment shown the feet are welded to the legs.

The assembled ladder may be hot dip galvanized and holes 6 may be provided to permit entry and exit of the galvanizing material in legs 3.

In use, the ladder is positioned so that the feet 4 are inserted into retaining or ladder clips on the vertical structure. Gravity acting on the ladder provides downward forces which draw the feet into contact with the clips and the structure.

Even with varying gaps between the retaining clip and the structure, the foot will be wedged in position, as long as there is a vertical downward force, and the ladder will not move in the horizontal direction. The weight of a person climbing the ladder supplies additional downward force to lock the ladder in position. The ladder is thereby stable without the need for set screws. The ladder however, is easily removed once the downward force is removed.

Figure 6:
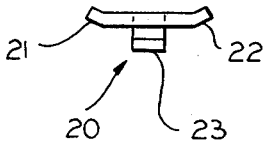
FIG. 6 is a top view of the ladder foot of FIG. 4.
Figure 5:
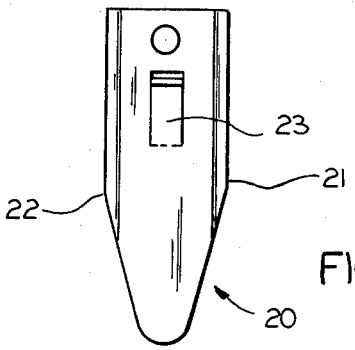
FIG. 5 is a plane view of the ladder foot of FIG. 4.
Figure 7:
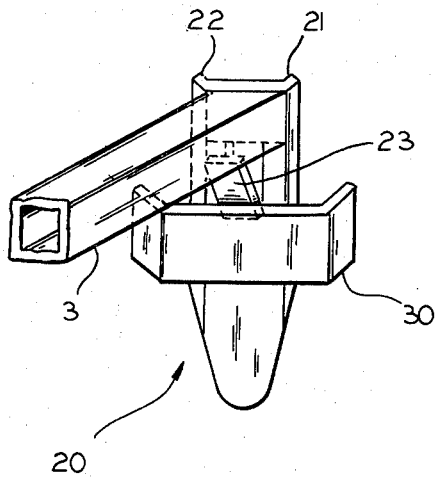
FIG. 7 is a perspective view of the foot of FIG. 4.

FIGS. 5, 6, and 7 show an alternate ladder foot 20 which may be attached to the legs of the ladder. The ladder foot 26 is of one piece construction formed from a $\frac{1}{4}''$ thick bar $1\frac{1}{2}'' \times 5''$. Side portions 21 and 22 are bent 15 degrees away from the plane of the ladder. A tongue 23 is bent 30 degrees toward the plane of the ladder and is $\frac{1}{2}'' \times 1\frac{1}{2}''$. When the ladder foot 20 is inserted into a retaining clip 30 attached to a structure, a three point suspension is formed. The edge of each side portion 21 and 22 contact the structure and tongue 23 contacts the retaining clip 30. Under load conditions the foot 20 will wedge between the clip 30 and the structure. Because the foot becomes tightly wedged between the clip and the structure.

The ladder cannot move in the horizontal direction and is therefore inherently stable without the use of set screws.

After the vertical downward force is removed, the ladder may be removed with minimal effort.

Figure 4:
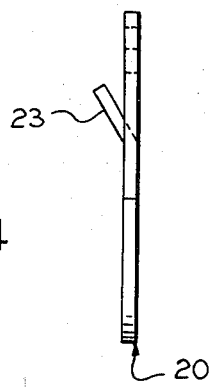
FIG. 4 is a side view of an alternate ladder foot.

A ladder constructed with either the ladder foot of FIG. 1 or 4 is substantially easier to galvanize than those presently manufactured. Additionally, the ladder construction is such that it weighs only 60% as much as ladders typically used.

What is claimed is:

1. A ladder for use or a structure having vertically spaced apart retaining clips, said ladder comprising:

a vertical member;

a plurality of rungs on said vertical member;

a leg extending substantially horizontal to said member; and a downwardly extending foot coupled to said leg and adapted to engage one of said retaining clips; said foot having a first portion substantially parallel to said vertical member for engaging the surface of said structure, and a second portion forming an angle with said first portion whereby when said first portion engages said structure, said second portion engages said clips.

2. A ladder in accordance with claim 1 wherein said foot is of one piece construction.

3. A ladder in accordance with claim 2 wherein said second portion is intermediate said first portion and said leg.

4. A ladder in accordance with claim 3 wherein said foot includes a third vertical portion coupled to said leg, said third vertical portion being intermediate said second portion and said leg.

5. A ladder in accordance with claim 2 wherein said second portion is a tongue extending from said first portion at a predetermined angle.

6. A ladder in accordance with claim 5 wherein said first portion includes extending from said first portion in an angular direction away from said vertical member, said tongue extending in the opposite direction from said first portion.

7. A ladder in accordance with claims 1, 2, 3, 4, 5 or 6 wherein said vertical member comprises flat-sided tubing.

8. A ladder in accordance with claim 7 wherein each of said plurality of rungs is formed from a metal angle.

9. A ladder in accordance with claim 8 wherein the ends of each rung are bent upward by a predetermined angle.

10. A ladder in accordance with claim 9 wherein said foot comprises a flat sided tube.

* * * * *